US007915513B2

(12) United States Patent
Ito

(10) Patent No.: US 7,915,513 B2
(45) Date of Patent: Mar. 29, 2011

(54) AUTOMATIC ACCOMPANIMENT GENERATING APPARATUS AND METHOD

(75) Inventor: Yoshihisa Ito, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/946,200

(22) Filed: Nov. 28, 2007

(65) Prior Publication Data

US 2008/0127813 A1 Jun. 5, 2008

(30) Foreign Application Priority Data

Nov. 30, 2006 (JP) ..... 2006-324171

(51) Int. Cl.
*G10H 1/28* (2006.01)

(52) U.S. Cl. ..... 84/638; 84/610; 84/634; 84/712; 84/716

(58) Field of Classification Search ..... 84/610, 84/634, 638, 712, 716
See application file for complete search history.

(56) References Cited

U.S. PATENT DOCUMENTS

| | | | | |
|---|---|---|---|---|
| 4,275,634 | A * | 6/1981 | Imamura et al. | 84/638 |
| 5,371,316 | A * | 12/1994 | Eitaki et al. | 84/634 |
| 5,410,097 | A * | 4/1995 | Kato et al. | 84/610 |
| 5,478,967 | A * | 12/1995 | Saito et al. | 84/612 |
| 5,854,619 | A * | 12/1998 | Kato | 345/23 |
| 5,973,253 | A * | 10/1999 | Hirata | 84/609 |
| 6,166,316 | A * | 12/2000 | Takahashi et al. | 84/619 |
| 6,177,624 | B1 * | 1/2001 | Takahashi et al. | 84/609 |
| 2003/0110927 | A1 * | 6/2003 | Kira | 84/613 |
| 2005/0016366 | A1 * | 1/2005 | Ito et al. | 84/716 |
| 2008/0072744 | A1 * | 3/2008 | Ito et al. | 84/638 |
| 2008/0072745 | A1 * | 3/2008 | Ito et al. | 84/638 |

FOREIGN PATENT DOCUMENTS

JP 2001022354 A 1/2001

* cited by examiner

*Primary Examiner* — Walter Benson
*Assistant Examiner* — Kawing Chan
(74) *Attorney, Agent, or Firm* — Rossi, Kimms & McDowell LLP

(57) ABSTRACT

An automatic accompaniment generating apparatus capable of generating automatic accompaniment as intended by a user. In an arpeggio sounding data generation mode, when key depression tones are input by a user's key depression operation after arpeggio pattern data is selected and a loop count is set to a value of "1" by the user, the sounding of the key depression tones is started, and the generation of a sounding data list is started based on the tone pitches of the key depression tones and sounding pattern data included in the selected arpeggio pattern data. In the case of the loop count being set to "1", the reproduction of the sounding data list is completed at the end of one bar, and thereafter only the key depression tones are sounded until a key release operation is performed by the user.

10 Claims, 7 Drawing Sheets

FIG. 3

SOUNDING PATTERN DATA

| Timing | Gate | Key | Oct | Vel |
|---|---|---|---|---|
| 0000 | 220 | 1 | +1 | 72 |
| 0240 | 220 | 3 | +0 | 72 |
| 0480 | 220 | 2 | +0 | 72 |
| 0720 | 220 | 1 | +0 | 72 |
| 0960 | 220 | 1 | +0 | 72 |
| 1200 | 220 | 2 | +0 | 72 |
| 1440 | 220 | 3 | +0 | 72 |
| 1680 | 220 | 1 | +1 | 72 |

SOUNDING DATA LIST FOR CASE WHERE C3, E3 AND G3 ARE INPUT

| Timing | Gate | Note | Vel |
|---|---|---|---|
| 0000 | 220 | C4 | 72 |
| 0240 | 220 | G3 | 72 |
| 0480 | 220 | E3 | 72 |
| 0720 | 220 | C3 | 72 |
| 0960 | 220 | C3 | 72 |
| 1200 | 220 | E3 | 72 |
| 1440 | 220 | G3 | 72 |
| 1680 | 220 | C4 | 72 |
| | | ..... | |

AUTOMATIC ACCOMPANIMENT GENERATING APPARATUS AND METHOD

BACKGROUND OF THE INVENTION

1. Field of the Invention

The present invention relates to automatic accompaniment generating apparatus and method in which automatic accompaniment data is generated based on supplied automatic accompaniment pattern data and input note information.

2. Description of the Related Art

An automatic accompaniment generating apparatus has conventionally been known that generates automatic accompaniment data based on supplied automatic accompaniment pattern data and input note information.

As such an automatic accompaniment generating apparatus, there is known a so-called arpeggiator that generates an arpeggio (broken chord) in response to a key depression. In the arpeggiator, arpeggio pattern data comprised of a plurality of key numbers (which are not note numbers corresponding to tone pitches, but are simple numbers) and sounding timings thereof are stored in advance, and numbers are assigned in advance to tone pitches of a plurality of tones in accordance with a predetermined rule (for example, in the order from low tone pitch). When plural keys are simultaneously depressed, the arpeggiator determines key numbers in the arpeggio pattern data corresponding to the depressed keys, and sequentially generates, at sounding timings, the tone pitches assigned with the numbers corresponding to the determined key numbers. As a result, an arpeggio is generated based on the key depression tones. In this way, when keys are depressed by the user, the arpeggiator sequentially generates and outputs sounding data in accordance with key depression tones and arpeggio pattern data. After completion of the generation and output of sounding data corresponding to the last part of the arpeggio pattern data, the first and subsequent parts of the arpeggio pattern data are again generated for output. As a result, so long as the keys are kept depressed by the user, the sounding data is continuously generated for output based on the key depression tones and the arpeggio pattern data. For the arpeggio generation, some arpeggiator uses fixed-note-type arpeggio pattern data, in part of which fixed tone pitches are specified (see, for example, Japanese Laid-open Patent Publication No. 2001-22354).

When a plurality of tones (for example, chord tones) are input by a key depression, the above-described prior art arpeggiator sounds the input chord, generates an arpeggio based on the input chord, and sounds the arpeggio. As described above, the arpeggio is continuously generated and sounded so long as the keys are kept depressed. In such a case, the chord is caused to be continuously sounded while the keys are kept depressed, and therefore, the arpeggio is sounded in an overlapping relation with the chord. With the above described conventional arpeggiator, even if the user wishes to produce tones by decoratively adding the arpeggio (more specifically, by restricting the number of times of sounding the arpeggio) while causing the chord to be continuously sounded, the arpeggio is continuously sounded in an overlapping relation with the chord (i.e., sounding the arpeggio cannot be restricted) while the keys for the chord are kept depressed. As a result, the above user's demand cannot be satisfied.

Some user wishes to use arpeggio pattern data once so as to generate an arpeggio corresponding to depressed keys only one time. To realize such arpeggio generation using the above-described conventional arpeggiator, the user is required to accurately grasp the entire length of the arpeggio pattern data to be used, and also required to accurately adjust a time period of depression of chord keys so as to use the arpeggio pattern data only one time. If the user fails to accurately adjust the time period of depression of the chord keys, the arpeggio pattern data does not end in the first-time use but ends during the second-time use. In that case, the arpeggio generation is unnaturally interrupted.

SUMMARY OF THE INVENTION

The present invention provides automatic accompaniment generating apparatus and method capable of generating an automatic accompaniment as intended by a user.

According to a first aspect of this invention, there is provided an automatic accompaniment generating apparatus comprising a supply unit adapted to supply automatic accompaniment pattern data, an input unit adapted to input at least one piece of note information including tone pitch information, a generation unit adapted to generate automatic accompaniment data based on the note information input by the input unit and the automatic accompaniment pattern data supplied by the supply unit, and an acquisition unit adapted to acquire number-of-times information that indicates a number of times the supplied automatic accompaniment pattern data is to be repeatedly used by the generation unit to generate the automatic accompaniment data, wherein the generation unit repeatedly uses the supplied automatic accompaniment pattern data the number of times indicated by the number-of-times information acquired by the acquisition unit, to thereby generate the automatic accompaniment data.

With this automatic accompaniment generating apparatus, when automatic accompaniment data is generated based on at least one piece of input note information and supplied automatic accompaniment pattern data, the automatic accompaniment pattern data is repeatedly used the number of times indicated by number-of-times information acquired, to thereby generate automatic accompaniment data. In other words, the automatic accompaniment data is generated while the number of times of using the automatic accompaniment pattern data is restricted as intended by a user. This makes it possible to generate an automatic accompaniment as intended by the user.

The generation unit can start generating the automatic accompaniment data in response to the at least one piece of note information being input, and can stop generating the automatic accompaniment data after the automatic accompaniment data is repeatedly generated the number of times indicated by the number-of-times information.

Non-specified information indicating that the number of times the supplied automatic accompaniment pattern data can be repeatedly used is not specified can be set as the number-of-times information, and when the non-specified information is set, the supplied automatic accompaniment pattern data can be repeatedly used until the at least one piece of note information is no longer input.

The number-of-times information can be set by a user.

The automatic accompaniment pattern data can be arpeggio pattern data.

According to a second aspect of this invention, there is provided an automatic accompaniment generating method comprising a supply step of supplying automatic accompaniment pattern data, a generation step of generating automatic accompaniment data based on at least one piece of input note information including tone pitch information and the automatic accompaniment pattern data supplied by the supply step, and an acquisition step of acquiring number-of-times information that indicates a number of times the supplied automatic accompaniment pattern data is to be repeatedly used by the generation step to generate the automatic accompaniment data, wherein the generation step repeatedly uses the supplied automatic accompaniment pattern data the number of times indicated by the number-of-times information acquired by the acquisition step, to thereby generate the automatic accompaniment data.

With the automatic accompaniment generating method, it is possible to attain advantages similar to those attained by the automatic accompaniment generating apparatus of this invention.

Further features of the present invention will become apparent from the following description of an exemplary embodiment with reference to the attached drawings.

BRIEF DESCRIPTION OF THE DRAWINGS

FIG. 3 is a view showing an exemplar format of sounding pattern data included in arpeggio pattern data and showing a sounding data list created based on the sounding pattern data and tone pitches of key depression tones input by a user's key depression operation;

DETAILED DESCRIPTION OF THE PREFERRED EMBODIMENT

The present invention will now be described in detail below with reference to the drawings showing a preferred embodiment thereof.

Figure 1:
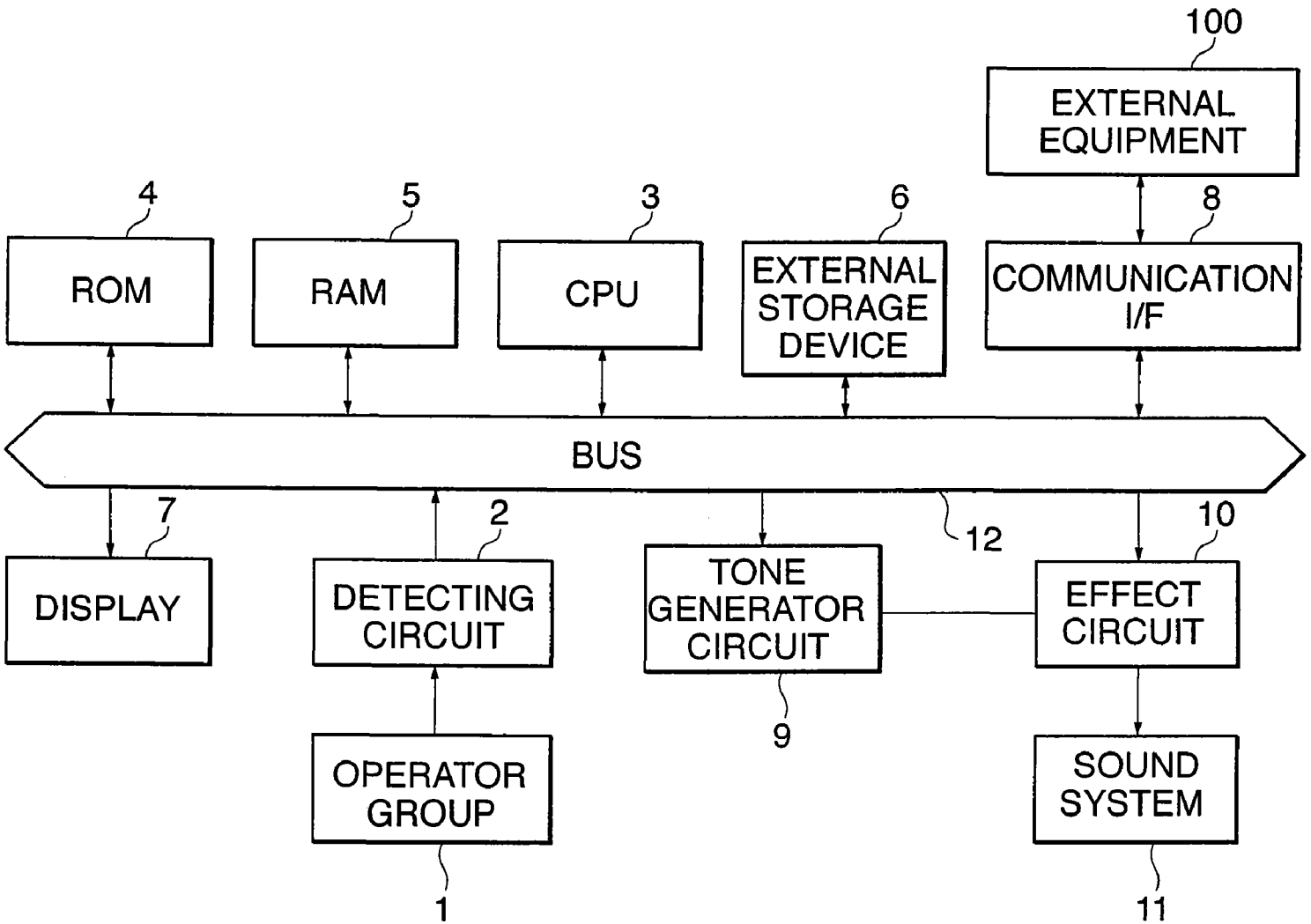
FIG. 1 is a block diagram schematically showing the construction of an arpeggiator to which is applied an automatic accompaniment generating apparatus according to one embodiment of this invention.

FIG. 1 is a block diagram schematically showing the construction of an arpeggiator to which is applied an automatic accompaniment generating apparatus according to one embodiment of this invention.

As shown in FIG. 1, the arpeggiator of this embodiment is comprised of an operator group 1 including performance operators such as a keyboard and setting operators such as various switches; a detecting circuit 2 for detecting operative states of the operators of the operator group 1; a CPU 3 that controls the entire apparatus; a ROM 4 that stores control programs executed by the CPU 3, various table data, etc.; a RAM 5 for temporarily storing musical performance information (note information) input via the performance operators, arpeggio pattern data, various input information, computation results, etc.; an external storage device 6 that stores various application programs including control programs, various arpeggio pattern data, various other data, etc.; a display 7 comprised of a liquid crystal display (LCD), light emitting diodes (LEDs), etc., for displaying various information and others; a communication interface (I/F) 8 that provides interface for connection to external equipment 100 such as external MIDI (Musical Instrument Digital Interface) equipment and performs transmission and reception of data to and from the external equipment 100; a tone generator circuit 9 that converts arpeggio sounding data generated based on the musical performance information input from the performance operators and the arpeggio pattern data stored in the RAM 5 into musical tone signals; an effect circuit 10 that applies various effects to musical tone signals supplied from the tone generator circuit 9; and a sound system 11 that converts musical tone signals from the effect circuit 10 into sounds and is comprised of a DAC (Digital-to-Analog Converter), an amplifier, a speaker, etc.

The above component elements 2 to 10 are connected to one another via a bus 12. The external equipment 100 is connected to the communication I/F 8, the effect circuit 10 to the tone generator circuit 9, and the sound system 11 to the effect circuit 10, respectively.

The external storage device 6 may be implemented, for example, by a flexible disk drive (FDD), a hard disk drive (HDD), a CD-ROM drive, or a magnetic-optical disk drive (MO). The external storage device 6 may store the control programs executed by the CPU 3 as mentioned above. If one or more of the control programs are not stored in the ROM 4, the control program(s) may be stored in the external storage device 6, and by reading out the control program(s) from the external storage device 6 and storing the same in the RAM 5, the CPU 3 can operate in the same manner as if the control program(s) were stored in the ROM 4. This enables adding control programs and upgrading the version of the control programs with ease.

Although in the illustrated example, the external equipment 100 is connected to the communication I/F 8, this is not limitative, but a server computer may be connected to the communication I/F 8 via a communication network such as a LAN (Local Area Network), the Internet, or a telephone line. When one or more of the above programs and various parameters are not stored in the external storage device 6, the communication I/F 8 is used to download such programs and parameters from the server computer. The arpeggiator as a client sends a command or commands for downloading one or more programs and parameters to the server computer via the communication I/F 8 and the communication network. Responsive to this command, the server computer distributes the requested program(s) and parameters to the arpeggiator via the communication network, and the arpeggiator receives the program(s) and parameters via the communication I/F 8 and stores them in the external storage device 6, thus completing the download.

Although the arpeggiator of this embodiment is constructed on the electronic keyboard musical instrument as understood from the above construction, this is not limitative, but the arpeggiator may be constructed on a general-purpose personal computer to which a keyboard is externally connected. The present invention can be embodied not only in a keyboard instrument type embodiment, but also in other embodiments of a string instrument type, a wind instrument type, a percussion instrument type, etc.

Control processing performed by the arpeggiator constructed as described above will be outlined with reference to FIGS. 2-4 and described in detail with reference to FIGS. 5 and 6.

The arpeggiator of this embodiment mainly performs the following processing:

(A) Sounding data list generation processing, in which sounding data list is generated based on musical performance information (tone pitches in this embodiment) input by a user's key depression operation and arpeggio pattern data selected by the user;

(B) Sounding data list reproduction processing, in which the sounding data list generated by the sounding data list generation processing (A) is reproduced; and (C) Sounding/muting processing, in which note on/off events are generated in response to a user's key depression/release operation and output to the tone generator circuit 9, thereby sounding/muting key depression/release tones.

Figure 2:
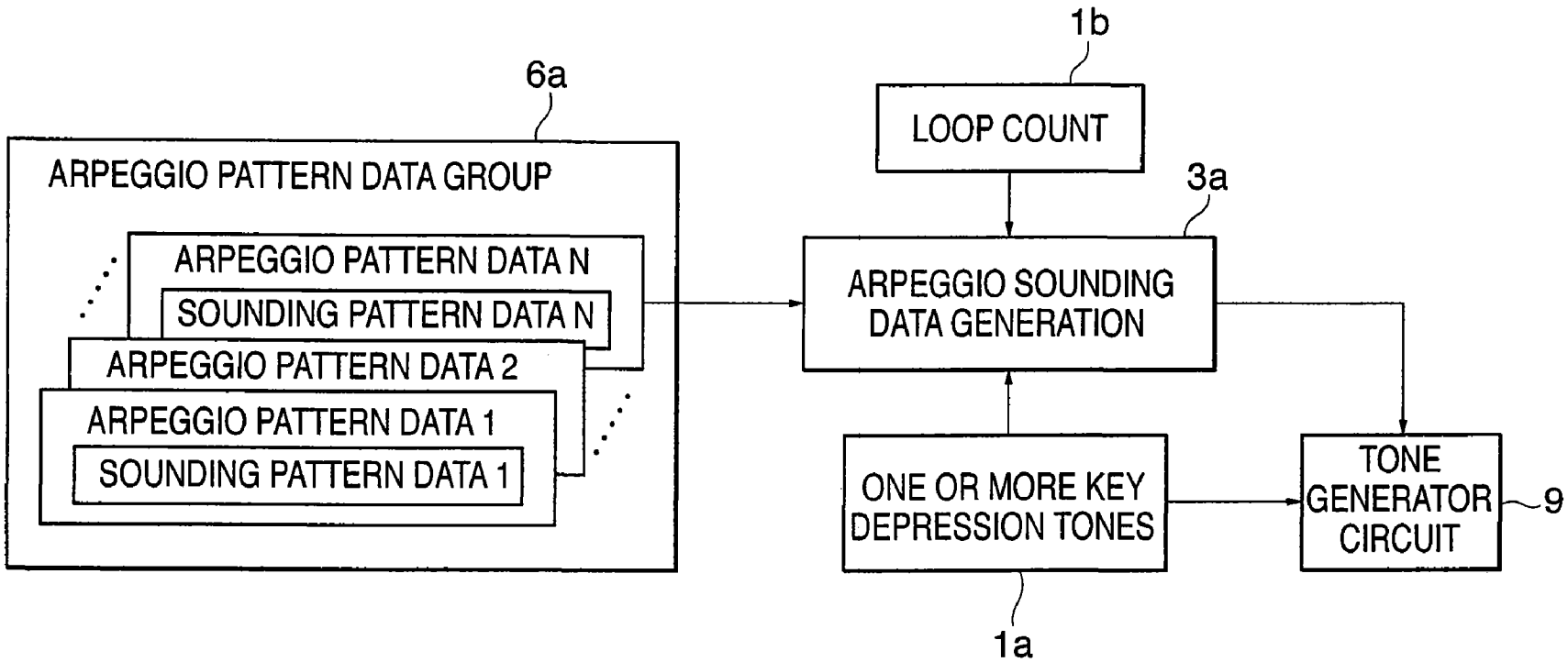
FIG. 2 is a block diagram showing the control system configuration for control processing performed by the arpeggiator of FIG. 1.

FIG. 2 is a block diagram showing the control system configuration for the control processing, i.e., the above-described processing (A) to (C), implemented by the arpeggiator of this embodiment. FIG. 3 is a view showing an exemplar format of sounding pattern data included in arpeggio pattern data and showing a sounding data list created based on the sounding pattern data and tone pitches of key depression tones input by a user's key depression operation.

A plurality types of arpeggio pattern data (e.g., for different tone colors) are stored beforehand, for example, in the external storage device 6. In this embodiment, an arpeggio pattern data group comprised of N sets of arpeggio pattern data each including sounding pattern data is stored in the external storage device 6, as shown by block 6*a* in FIG. 2. When any of the arpeggio pattern data is selected by the user, the selected arpeggio pattern data is read out from the external storage device 6 and stored into an arpeggio pattern data storage region (not shown) provided at a predetermined position in the RAM 5. FIG. 2 shows how arpeggio sounding data is generated in accordance with the arpeggio pattern data N selected by the user from the arpeggio pattern data group.

Each arpeggio pattern data includes sounding pattern data. As shown in FIG. 3, the sounding pattern data is comprised of plural sets of data. Each set of data includes sounding timing (Timing), gate time (Gate), key number (Key), octave (Oct), and velocity (Vel). The sounding timing represents, in terms of the number of clocks, a timing at which is to be sounded a key depression tone that is indicated by the key number corresponding to the sounding timing (i.e., by the key number belonging to the same set of data as that to which the sounding timing belongs). In this embodiment, a time period of one beat is represented by 480 clocks. The gate time represents, in terms of the number of clocks, sounding duration time (i.e., tone length) of the key depression tone whose sounding is started at the sounding timing. The key numbers are numbered in the order from low tone pitch to high tone pitch for key depression tones that are input when a plurality of keys are simultaneously depressed by the user (the key depression start timings may be the same or deviated from each other as long as there is a time period in which these keys are simultaneously in a depressed state (ditto in the following)). The octave indicates how much the key depression tone represented by the key number corresponding to the octave is octave-shifted. The velocity indicates a value of velocity with which the key depression tone represented by the key number corresponding to the velocity is sounded.

The sounding data list is shown in FIG. 3 that is generated using the sounding pattern data when three tone pitches "C3", "E3" and "G3" are input by a user's key depression. The key depression tones "C3", "E3" and "G3" are assigned with the key numbers of "1", "2" and "3" in accordance with the rule described above. During one and one-half beats ("0719") from the head ("0000") of the sounding data list, the following note numbers (Note) are generated at the following generation timings.

At the timing of "0000", C4 is generated (which is obtained by making a one-octave shift of the tone pitch ("C3") of the key depression tone corresponding to the key number "1").

At the timing of "0240", G3 is generated (which is obtained by making a zero-octave shift of the tone pitch ("G3") of the key depression tone corresponding to the key number "3").

At the timing of "0480", E3 is generated (which is obtained by making a zero-octave shift of the tone pitch ("E3") of the key depression tone corresponding to the key number "2").

At respective timings in the subsequent beats, other note numbers are generated.

In this embodiment, the sounding pattern data are used each having a length thereof corresponding to the length of one bar (in four-four time in the example of FIG. 3). As described later, when a loop count (indicating the number of times the sounding pattern data can repeatedly be used) is set to be "unspecified", the generation of the sounding data list (shown by block 3*a* in FIG. 2) is not stopped until a key release operation is performed by the user. If a time period from a user's key depression operation to a key release operation exceeds the length of one bar, the sounding data list is generated for a length of time exceeding one bar. When the sounding data list is generated for a length of time exceeding one bar with the key depression tone kept unchanged, note numbers generated in the first bar are repeatedly generated in the second and subsequent bars. The sounding pattern data may have any length other than the length of one bar.

Referring to FIG. 2 again, a shift to an arpeggio sounding data generation mode is made in accordance with a user's instruction. After selecting arpeggio pattern data and setting the loop count (block 1*b*), the user instructs the start of generation of arpeggio sounding data, and then performs a key depression operation to thereby input at least one key depression tone (block 1*a*). The input key depression tone (including at least a key code and a velocity) is stored into a key-on buffer (not shown) provided at a predetermined position in the RAM 5. The CPU 3 always checks the state of the key-on buffer. When a key depression tone is stored in the key-on buffer, a note-on event corresponding to the key depression tone is generated and output to the tone generator circuit 9 by the CPU 3. In response to this, the tone generator circuit 9 generates a musical tone signal corresponding to the input note-on event, and outputs the same to the effect circuit 10, whereby the key depression tone is sounded by the sound system 11.

Next, the CPU 3 creates a sounding data list based on the arpeggio pattern data selected as described above and the tone pitch (key code) of the key depression tone stored in the key-on buffer as described above (block 3*a*). During the creation of the sounding data list, the arpeggio pattern data is used the number of times corresponding to the loop count set as described above. In this embodiment, the loop count may be set to a natural number (1, 2, . . . ) or set to be "unspecified". When the loop count is set to, for example, a value of "2", the CPU 3 repeatedly uses the arpeggio pattern data twice, to thereby create the sounding data list based on the key depression tone. When the loop count is set to be "unspecified", the CPU 3 repeatedly uses the arpeggio pattern data until the key depression tone is no longer input, to thereby create the sounding data list based on the key depression tone.

The sounding data list thus created (or now being created) is reproduced by the sounding data list reproduction processing (B) provided in timer interrupt processing (not shown). More specifically, the sounding data list reproduction processing (B) is realized as follows:

(i) A free-run counter (not shown) provided at a predetermined position in the RAM 5 is counted up each time the timer interrupt processing is caused to start. For example, the timer interrupt processing is started at intervals equal to one period of the clock.

(ii) A count value of the free-run counter is compared with a sounding timing in the sounding data list. If it is determined that they are coincident with each other, a note number and a velocity corresponding to the sounding timing are read out from the sounding data list, and a note-on event including the note number and the velocity is generated and output to the tone generator circuit 9.

(iii) When a note-on event is generated in the step (ii), the free-run counter detects a value that is counted from the time point of generation of the note-on event to the present time point, and compares the detected value with a gate time corresponding to the generated note-on event. When determining that they are coincident with each other, the free-run counter generates a note-off event corresponding to the generated note-on event and outputs the same to the tone generator circuit 9.

Needless say, the free-run counter must be reset at a predetermined timing such as a timing of start of a key depression. Normally, the resetting is performed by setting the free-run counter to a value of "0". In this embodiment, however, the free-run counter is set to a value of "−1" to thereby reset the free-run counter. This is because since the count value of the free-run counter is compared with a sounding timing after the count up of the free-run counter is started in this embodiment as described above, an event whose sounding timing is at a position of "0000" cannot be detected, if the free-run counter is reset to a value of "0".

Figure 4A:
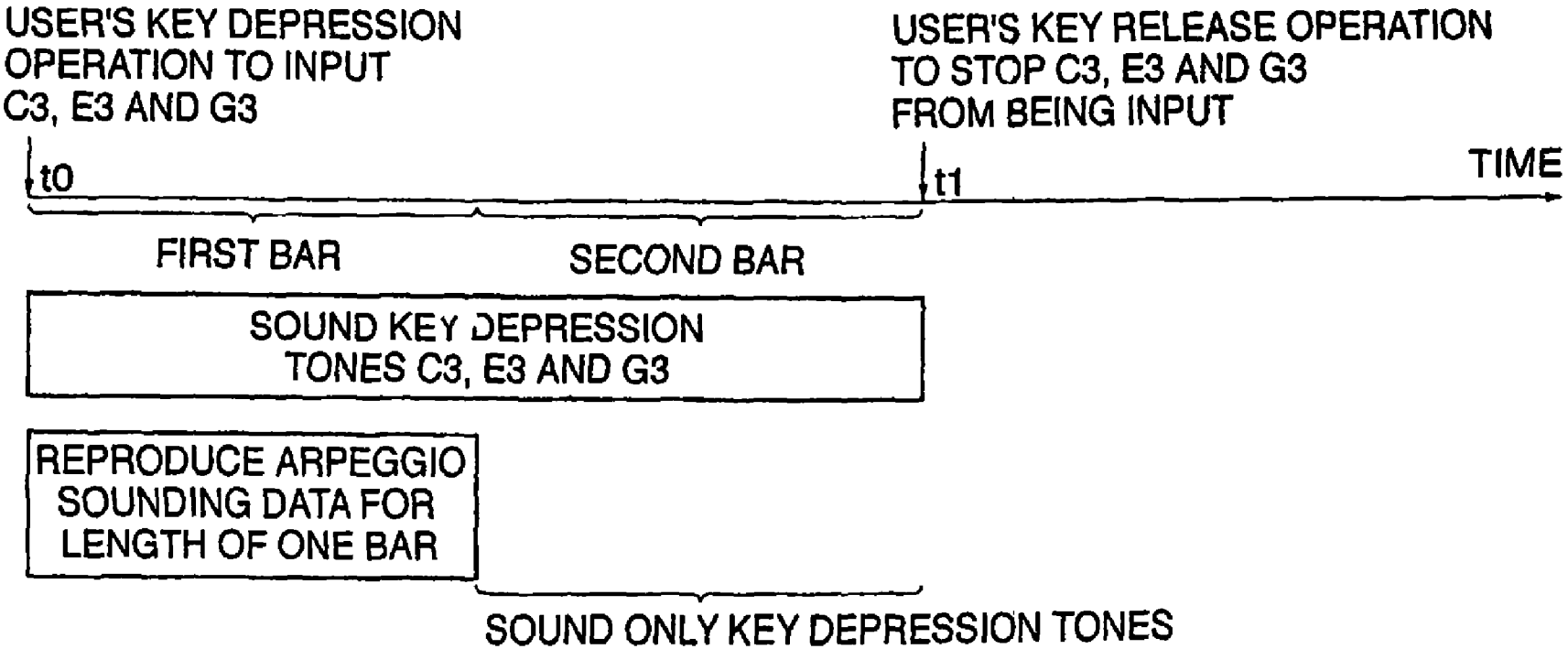
FIG. 4A is a view for explaining an example of the control processing performed by the arpeggiator of FIG. 1 when a loop count is set to a value of "1"
Figure 4B:
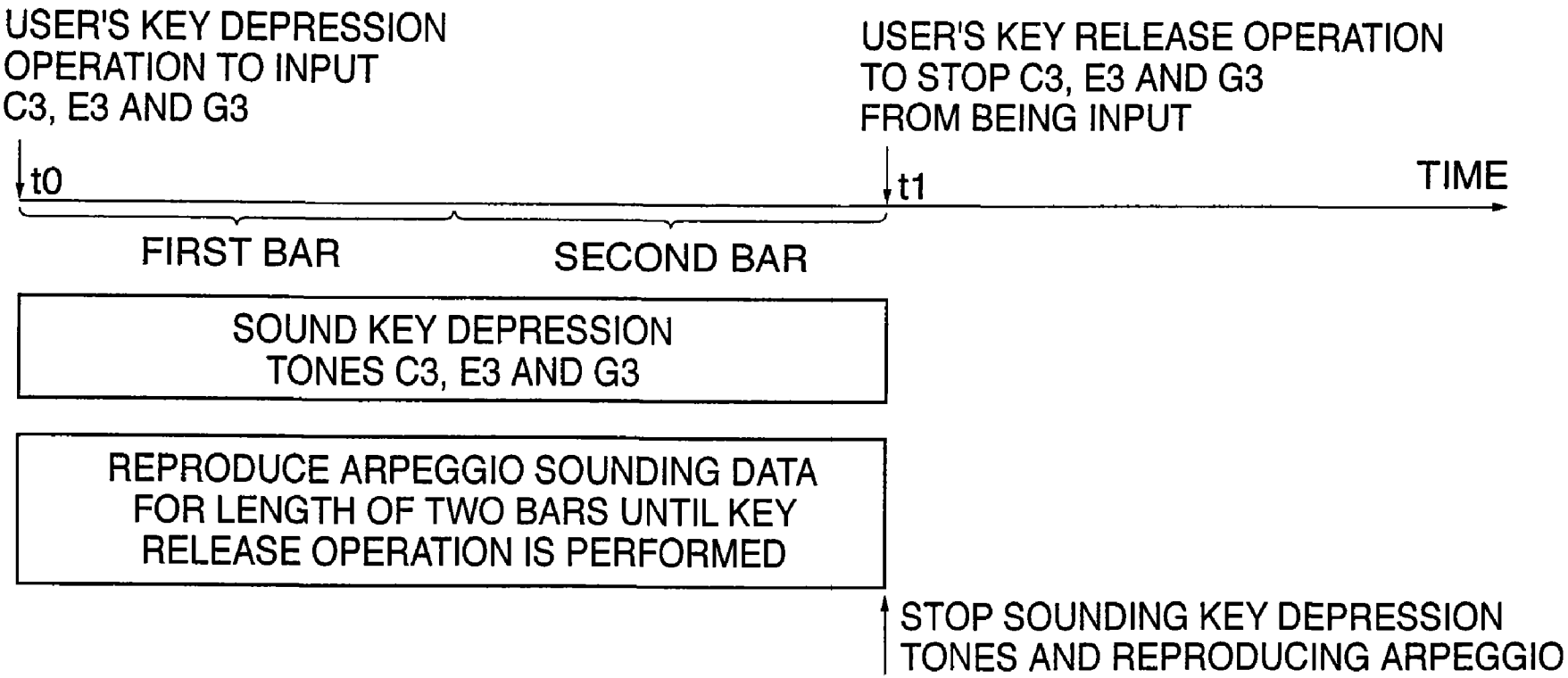
FIG. 4B is a view for showing an example of the control processing when the loop count is set to be unspecified.

FIG. 4 is a view for explaining the control processing performed by the arpeggiator of this embodiment. Specifically, FIG. 4A shows an example of the control processing performed when the loop count is set to a value of "1" and FIG. 4B shows an example of the control processing performed when the loop count is set to be "unspecified".

As shown in FIG. 4A, in response to a user's instruction, a shift is made to an arpeggio sounding data generation mode in which the user can select arpeggio pattern data, can set the loop count to a value of "1", and can instruct the start of generation of arpeggio sounding data. In that case, when the user performs a key depression operation to input key depression tones "C3", "E3" and "G3" at a time point of "t0", the CPU 3 generates note-on events corresponding to the key depression tones and outputs them to the tone generator circuit 9, whereby the sounding of the key depression tones is started. In addition, the CPU 3 starts the generation of arpeggio sounding data (sounding data list) based on the tone pitches of the key depression tones and sounding pattern data included in the selected arpeggio pattern data. The generated sounding data list is reproduced by the sounding data list reproduction processing (B) provided in the timer interrupt processing, as described previously. In the illustrated example, the generated sounding data list has a length equal to the length of one bar. If the user's key depression operation is continued for a time period longer than the length of one bar, the reproduction of the sounding data list is completed when the reproduction is performed for the length of one bar, and thereafter only the key depression tones are sounded. When the user performs a key release operation at a time point of "t1" and the key depression tones "C3", "E3" and "G3" are no longer input, the CPU 3 generates note-off events corresponding to the key depression tones and outputs the same to the tone generator circuit 9, whereby the key depression tones are muted.

In the case shown in FIG. 4B, only the setting of the loop count is changed from the case of FIG. 4A in that the loop count is set to be "unspecified". In the case of FIG. 4B, the reproduction of the sounding data list is started when a key depression operation is performed by the user and continued until a key release operation is performed by the user. This is the same as the processing performed by the prior art arpeggiator. In other words, the arpeggiator of this embodiment is configured to be capable of selectively carrying out, in accordance with a user's intention, either the processing (shown in FIG. 4A) which cannot be carried out by the prior art arpeggiator or the processing (shown in FIG. 4B) which can be carried out by the prior art arpeggiator.

As described above, with the arpeggiator of this embodiment, the user wishing to produce tones such that the arpeggio is decoratively added to the continuously sounded chord (while restricting the number of times of sounding the arpeggio) can set the number of times of sounding the arpeggio by setting the loop count. In that case, the arpeggio can be sounded only the set number of times in an overlapping relation with the chord, even if the keys for the chord is kept depressed thereafter. In other words, with the arpeggiator of this embodiment, the arpeggio can be sounded in an overlapping relation with the chord for a time period corresponding to a part of the sounding duration time of the chord. As a result, it is possible to satisfy the user's demand of producing tones such that the arpeggio is decoratively added to the chord while the chord is continuously sounded. Thus, it is possible for the user to produce intended tones using the arpeggio or perform an intended musical performance using the arpeggio.

With the arpeggiator of this embodiment, the number of times of sounding the arpeggio can be set to, e.g., a value of "1". In that case, even if keys for a chord are depressed for a time period longer than the length of arpeggio pattern data used for sounding the arpeggio (more strictly, the time period of reproduction of sounding data list generated using the arpeggio pattern data), the arpeggio pattern data is used only once and the arpeggio is sounded only one time. As a result, the user can release the depressed keys for the chord without considering the length of the arpeggio pattern data. Thus, the user can concentrate on playing the musical performance.

Next, the control processing will be described in detail.

Figure 5:
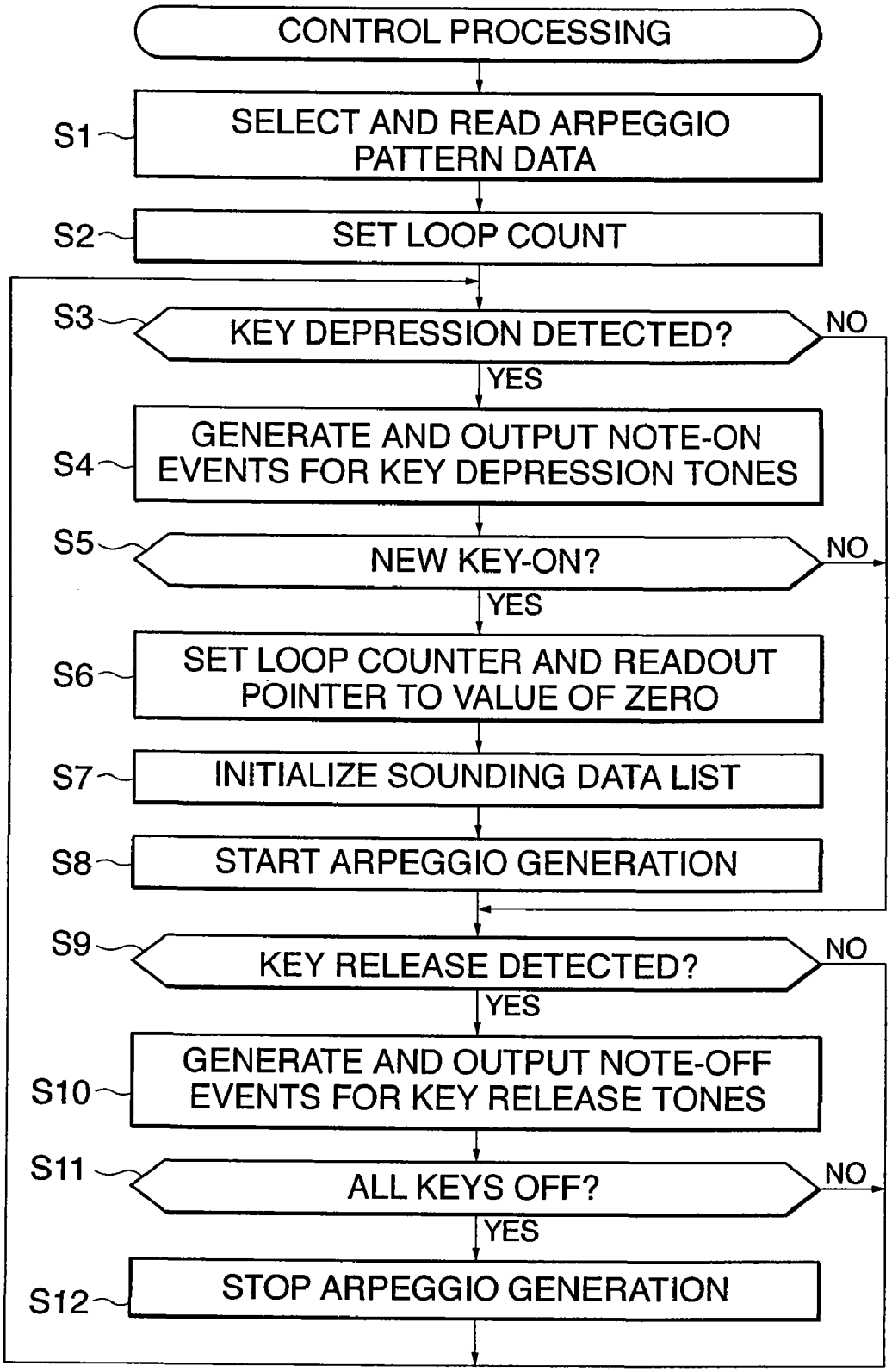
FIG. 5 is a flowchart showing procedures of the control processing implemented by the arpeggiator of FIG. 1, especially, by a CPU thereof.
Figure 6:
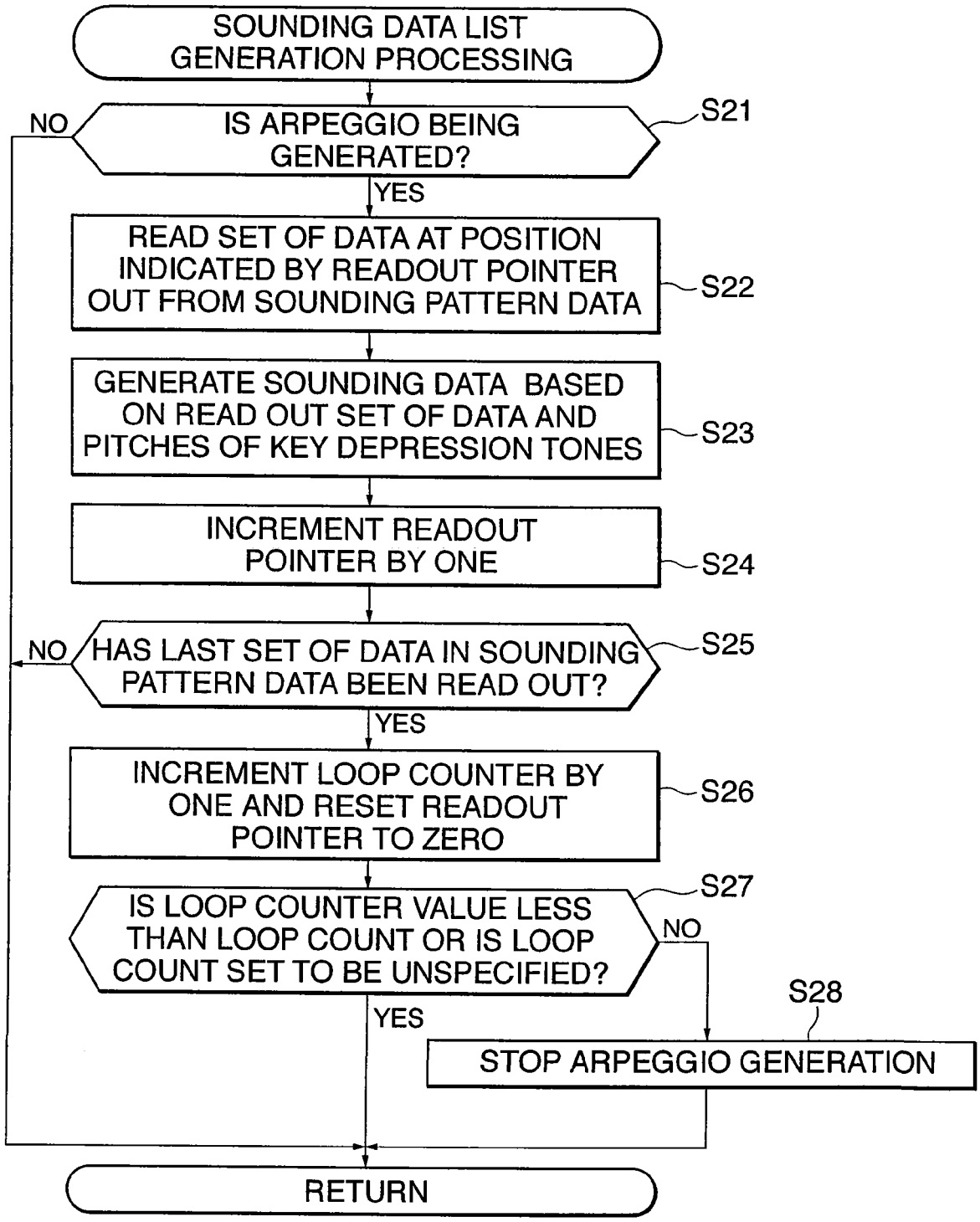
FIG. 6 is a flowchart showing procedures of sounding data list generating processing implemented by the arpeggiator of FIG. 1, especially, by the CPU thereof.

FIGS. 5 and 6 are flowcharts showing procedures of the control processing and the sounding data list generation processing implemented by the arpeggiator of this embodiment, especially, by the CPU 3 thereof. The control processing is caused to start when the arpeggio sounding data generation mode is selected by the user. The sounding data list generation processing is included in the timer interrupt processing that is caused to start at intervals of period equal to one period of the clock.

In the control processing, the following processing is mainly carried out.

(1) Initial setting processing (steps S1 and S2)

(2) Sounding/muting processing (C) (steps S3, S4, S9, and S10)

(3) Arpeggio generation start/stop processing (steps S5 to S8, S11, and S12)

In the initializing processing (1), the CPU 3 causes the display 7 to display thereon a list of arpeggio pattern data group stored in the external storage device 6, thereby showing the list to the user. When any of arpeggio pattern data is selected by the user, the CPU 3 reads the selected arpeggio pattern data from the external storage device 6 into the arpeggio pattern data storage region (step S1). Next, the CPU 3 causes the display 7 to display thereon a list of candidates that can be set as the loop count to show the candidates to the user. When the user selects any of the candidates, the selected number of times or the selected choice "unspecified" is stored in a loop count storage region (not shown) provided at a predetermined position in the RAM 5 (step S2). When the user does not select any of the candidates as the loop count, the choice "unspecified" which is the default choice is stored in the loop count storage region.

In the sounding/muting processing (2), the CPU 3 first acquires musical performance information (one or more key depression tones) output from the detecting circuit 2 in response to a user's key depression operation and stores the same in the key-on buffer (step S3). Next, based on the key depression information stored in the key-on buffer, the CPU 3 generates one or more note-on events and outputs the same to the tone generator circuit 9 (step S4). The user's key depression operation is not necessarily to depress a plurality of keys but may be to depress one key. When acquiring the key release information (one or more key release tones) output from the detecting circuit 2 in response to a user's key release operation, the CPU 3 generates one or more note-off events based on the acquired key depression information, and outputs the same to the tone generator circuit 9 (steps S9 and S10). As a result, as shown in FIG. 4, the key depression tones are continuously sounded from when the key depression operation is performed to when the key release operation is performed by the user.

In the arpeggio generation start/stop processing (3), the CPU 3 determines whether or not the key depression detected in the step S3 is new key-on (i.e., an initial key depression performed from a state where no key is depressed) (step S5). If the new key-on is detected, a loop counter (not shown) provided in a predetermined position in the RAM 5 for counting the loop count is reset to zero, and a readout pointer (not shown) provided in a predetermined position in the RAM 5 and specifying a position of a set of data to be read out from the sounding pattern data in the selected arpeggio pattern data is reset to zero (step S6), thereby initializing (clearing) the sounding data list (step S7). The sounding data list is created in a region provided in a predetermined position in the RAM 5. Then, the arpeggio generation is started (step S8).

On the other hand, if the key release detected in the step S9 during the arpeggio generation indicates an all key-off (a state where all the keys are released from the key depression state), the arpeggio generation is caused to stop (steps S11 and S12). At this time, the CPU 3 adjusts, where desired, a muting timing at which sounding data in the sounding data list is muted after execution of the user's key release operation. The case of requiring the muting timing adjustment includes, for example, a case where a key release operation is performed before the arpeggio pattern data is not used for the entire time period represented by the set loop count. In that case, it is preferable that the arpeggio generation should be continued to the next break position (i.e., the end of a bar, a beat, or a pattern concerned) after the key release operation is detected. However, this is not limitative. The arpeggio generation can be immediately stopped without making the muting timing adjustment when the key release operation is detected. Alternatively, the arpeggio generation can be continued until the time period represented by the set loop count has elapsed.

In the sounding data list generation processing of FIG. 6 (corresponding to the sounding data list generation processing (A)), the CPU 3 reads a set of data at a position indicated by the readout pointer out from the sounding pattern data included in the selected arpeggio pattern data, while the arpeggio is being generated (steps S21 and S22). Based on the read out set of data and the tone pitches of the key depression tones, the CPU generates sounding data using the above described method, and writes the same in the sounding data list (step S23). Whereupon, a value of the readout pointer is incremented by "1" (step S24). When it is determined at step S25 that the read out set of data does not correspond to the last set of data in the sounding pattern data, the sounding data list generation processing is completed. On the other hand, when the read out set of data corresponds to the last data of the sounding pattern data, the loop counter is incremented by "1" and the readout pointer is reset to zero (steps S25 and S26). When it is determined at step S27 that a count value of the loop counter is less than the natural number having been set as the loop count or that the loop count has been set to be "unspecified", the sounding data list generation processing is finished without the arpeggio generation being stopped. On the other hand, if the count value of the loop counter is equal to the set loop count, the arpeggio generation is caused to stop (steps S27 and S28), and then the sounding data list generation processing is finished.

The processing to reproduce the generated sounding data list to thereby sound the arpeggio has been described above, and therefore, an explanation thereof is omitted.

In this embodiment, the case has been described in which the automatic accompaniment generating apparatus of this invention is applied to the arpeggiator, and as a result, there is generated arpeggio data, which is different from automatic accompaniment data of a type generated in an ordinary automatic accompaniment apparatus. The reason why such a case has been described is to simplify the explanation. The present invention can be applied not only to the generation of arpeggio data but also to the generation of automatic accompaniment data of a type generated by ordinary automatic accompaniment apparatus.

In this embodiment, the sounding data list reproduction processing (B) is carried out in the timer interrupt processing, but this is not limitative. The sounding data list reproduction processing (B) can be performed in the control processing shown in FIG. 5.

In this embodiment, it is assumed that a plurality of arpeggio pattern data are stored in advance in the external storage device 6, but this is not limitative. These arpeggio pattern data can be stored in advance in the ROM 4. Alternatively, arpeggio pattern data on a network can be acquired via the communication I/F 8.

In this embodiment, the loop count is arranged to be set to an arbitrary natural number, but this is not limitative. The loop count can be fixedly set to a predetermined number of times (for example, one time). Alternatively, the loop count can be selectively set to a predetermined number of times or set to be "unspecified". The predetermined number of times can be fixedly set. Alternatively, the loop count can be determined for each arpeggio pattern data. In that case, when the arpeggio pattern data is selected, the loop count corresponding to the selected arpeggio patter data can automatically be set as the predetermined number of times.

In this embodiment, the note information to be referred to by the arpeggio pattern data is input by the user by performing a realtime musical performance (i.e., the data is input as one or more key depression tones), but this is not limitative. The note information can be obtained by reproducing a musical performance information file that is prepared in advance by the user or by reproducing an existing musical performance information file.

It is to be understood that the present invention may also be accomplished by supplying a system or an apparatus with a storage medium in which is stored a program code of software that realizes the functions of the above described embodiment, and then causing a computer (or CPU or MPU) of the system or apparatus to read out and execute the program code stored in the storage medium.

In this case, the program code itself read out from the storage medium realizes the functions of the embodiment, and hence the program code and the storage medium in which the program code is stored constitute the present invention.

The storage medium for supplying the program code may be, for example, a flexible disk, a hard disk, a magnetic-optical disk, an optical disk such as a CD-ROM, a CD-R, a CD-RW, a DVD-ROM, a DVD-RAM, a DVD-RW, or a DVD+RW, a magnetic tape, a non-volatile memory card, or a ROM. Alternatively, the program may be supplied via a communication network from a server computer.

Moreover, it is to be understood that the functions of the embodiment can be accomplished not only by executing the program code read out by the computer, but also by causing an OS (operating system) or the like which operates on the computer to perform a part or all of the actual operations based on instructions of the program code.

Furthermore, it is to be understood that the functions of the embodiment can also be accomplished by writing a program code read out from the storage medium into a memory provided on an expansion board inserted into the computer or in an expansion unit connected to the computer and then causing a CPU or the like provided on the expansion board or in the expansion unit to perform a part or all of the actual operations based on instructions of the program code.

What is claimed is:

1. An automatic accompaniment generating apparatus comprising:

a supply unit adapted to supply automatic accompaniment pattern data;

an input unit adapted to input at least one piece of note information including tone pitch information;

a generation unit adapted to generate automatic accompaniment data only based on the note information input by said input unit and the automatic accompaniment pattern data supplied by said supply unit; and an acquisition unit adapted to acquire number-of-times information that indicates a number of times the supplied automatic accompaniment pattern data is to be repeatedly used by said generation unit to generate the automatic accompaniment data, wherein said generation unit stops generating the automatic accompaniment data after the supplied automatic accompaniment pattern data is repeatedly generated the number of times indicated by the number-of-times information acquired by said acquisition unit, even while the at least one piece of note information is continuously input, and wherein the number-of-times information comprises any natural number.

2. The automatic accompaniment generating apparatus according to claim 1, wherein:

non-specified information, which indicates that the number of times the supplied automatic accompaniment pattern data is repeatedly usable is not specified, is settable as the number-of-times information, and when the non-specified information is set, the supplied automatic accompaniment pattern data is repeatedly used until the at least one piece of note information is no longer input.

3. The automatic accompaniment generating apparatus according to claim 1, wherein the number-of-times information is set by a user.

4. The automatic accompaniment generating apparatus according to claim 1, wherein the automatic accompaniment pattern data is arpeggio pattern data.

5. The automatic accompaniment generating apparatus according to claim 1, wherein the generation unit includes a loop counter that is set to the number-of-times information.

6. An automatic accompaniment generating method comprising:

a supply step of supplying automatic accompaniment pattern data;

a generation step of generating automatic accompaniment data based on only at least one piece of input note information including tone pitch information and the automatic accompaniment pattern data supplied in said supply step; and an acquisition step of acquiring number-of-times information that indicates a number of times the supplied automatic accompaniment pattern data is to be repeatedly used in said generation step to generate the automatic accompaniment data, wherein said generation step stops generating the automatic accompaniment data after the supplied automatic accompaniment pattern data is repeatedly generated the number of times indicated by the number-of-times information acquired in said acquisition step, even while the at least one piece of note information is continuously input, and wherein the number-of-times information comprises a real number.

7. The automatic accompaniment generating method according to claim 6, wherein:

non-specified information, which indicates that the number of times the supplied automatic accompaniment pattern data is repeatedly usable is not specified, is settable as the number-of-times information, and when the non-specified information is set, the supplied automatic accompaniment pattern data is repeatedly used until the at least one piece of note information is no longer input.

8. The automatic accompaniment generating method according to claim 6, wherein the number-of-times information is set by a user.

9. The automatic accompaniment generating method according to claim 6, wherein the automatic accompaniment pattern data is arpeggio pattern data.

10. The automatic accompaniment generating method according to claim 6, wherein the generation step includes the step of setting a loop counter to the number-of-times information.

* * * * *